United States Patent [19]

Averitt et al.

[11] Patent Number: 4,856,669

[45] Date of Patent: Aug. 15, 1989

[54] REVOLVING REFUSE HOLDER

[76] Inventors: Chester C. Averitt, 904 N. Cedar St., Foley, Ala. 36535; Thomas R. Byrne, 10231 Bayou Cir., Fairhope, Ala. 36532

[21] Appl. No.: 217,672

[22] Filed: Jul. 11, 1988

[51] Int. Cl.[4] ..... B65B 67/12; A47F 5/02

[52] U.S. Cl. ..... 220/1 T; 248/95; 248/131; 248/156; 248/907

[58] Field of Search ..... 248/95, 131, 156, 146, 248/545, 916, DIG. 7; 220/1 T

[56] References Cited

U.S. PATENT DOCUMENTS

| | | | |
|---|---|---|---|
| 727,107 | 8/1903 | Donaldson | 211/131 |
| 1,721,299 | 7/1929 | Harrison | 248/146 |
| 2,175,134 | 10/1939 | Smith | 248/131 |
| 2,861,764 | 11/1958 | Fisher | 248/156 |
| 3,178,142 | 4/1965 | Koch | 248/156 |
| 3,428,319 | 2/1969 | Engle | 248/156 |
| 3,642,145 | 2/1972 | Shelton | 248/131 |
| 4,706,921 | 11/1987 | Paulin | 248/156 |

FOREIGN PATENT DOCUMENTS

| | | | |
|---|---|---|---|
| 251173 | 10/1947 | Switzerland | 248/156 |

*Primary Examiner*—A. Michael Chambers

[57] ABSTRACT

A concave shaped rigid member whose principle axis lies in the horizontal plane and is mounted on a post lying in a vertical plane, said concaved member adaptable for holding refuse bags or the like, at a height which is adjustable to provide insusceptibility for encroachment from animals, and said concaved member being provided with a means of rotation and drainage.

2 Claims, 1 Drawing Sheet

REVOLVING REFUSE HOLDER

BACKGROUND OF THE INVENTION

In the past decade the plastics industry has tremendously aided in the collection of refuse from both residential and commercial areas. Refuse bags generally made from polyethylene are used to line a rigid container inside the premises. These bags are then used to contain the refuse, and when filled, the mouth is constricted and placed outside upon waiting collection from a refuse company.

This is where problems are generally encounted. Bags must be stored outside for varying lengths of time, depending upon the frequency of collection by the refuse company. While outside, they become susceptible to animal behavior, and due to the nature of the refuse bag, it can easily be opened by animals. If the bags are ripped open, poor aesthetics and health situations are exposed to the neighborhood and present a scattered, unpleasant mess to be gathered.

One object of this invention is to eliminate this problem by providing a novel holder for the refuse bag(s) which is mounted on a post in the air. This holder is designed to revolve about its vertical axis whereby preventing animals from obtaining a grip by repeatedly spinning away from them as they jump up, attempting to grab the holder.

Other refuse bag holders have been developed as in McMillen et al., U.S. Pat. No. 4,339,048. However, they do not provide a method of rotation. The rotation significantly increases the effectiveness by not allowing animals to grab the holder which could generate a bending moment on the vertical member. Bending moments cause stresses which can fatique the member allowing it to yield, eventually resulting in failure of the product.

Another advantage of this invention over prior art provides a uniquely shaped smooth concaved member to hold the refuse bags. This smooth concaved shape does not allow small animals such as cats or rodents to grab on to the holder climbing up and over into it. Thus, they are denied access to the contents of the bag, which is a possibility with other types of containers.

Another advantage of this invention enables one to vary the height of the refuse holder through use of a setscrew collar which when tightened at the desired height, prevents vertical downward movement of the holder. This can be a valuable asset if a big animal is causing a problem in the area.

A further advantage of this invention over prior art is to provide handles on the refuse holder allowing one to easily transport the holder loaded with refuse from its storage to the mounting position, and back to storage again after use.

Still, another important advantage of the holder's rotating capability is it allows the refuse collector to stand in one location as the collecting vessel is loaed. One simply rotates the holder around to a convenient position as each bag is removed.

A further advantage of this invention is to provide a refuse holder which can be manufactured in a variety of sizes for holding a variable number of refuse bags, and placed in any type of support strata more of which will become apparent in the accompanying drawings.

DESCRIPTION OF THE PREFERRED EMBODIMENT

Figure 1:
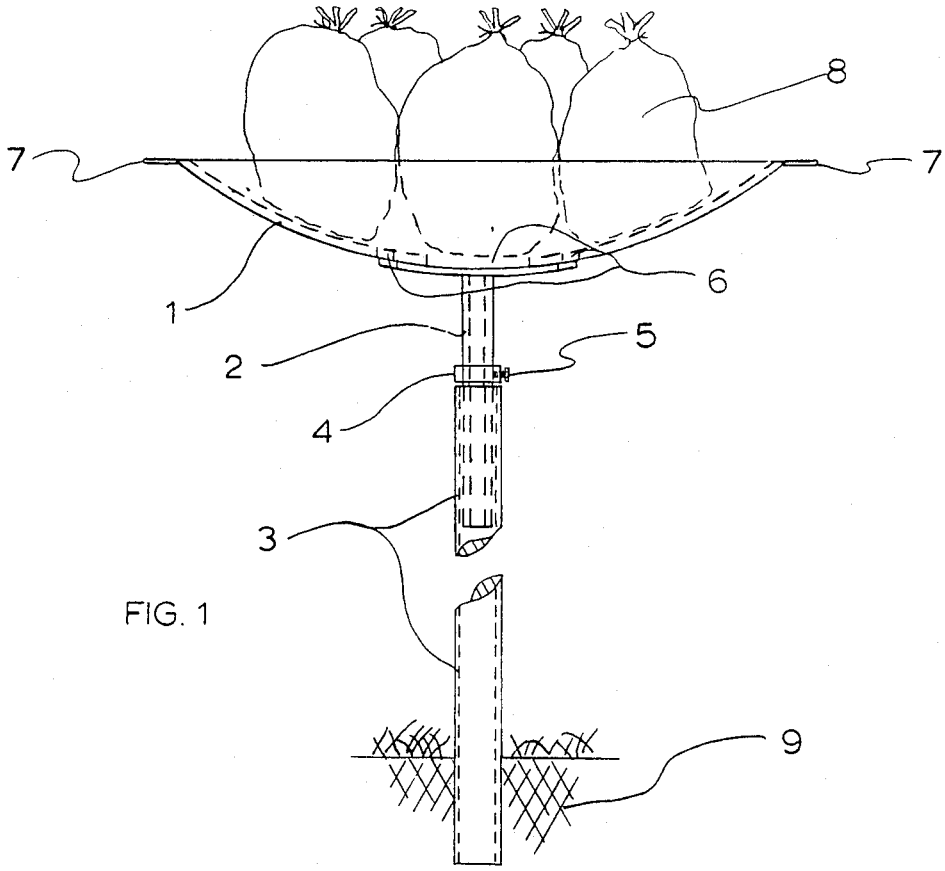
FIG. 1 is a profile view of the Revolving Refuse Holder constructed in accordance with the invention.

Referring now to the drawings and, in particular, FIG. 1, a Revolving Refuse Holder is shown constructed in accordance with the invention.

In FIG. 1 the invention is formed from a concaved shaped rigid member 1 lying in a horizontal plane, and having an integrally mounted vertical stem 2, being circular in cross section, extending downward in a vertical plane from said concaved member 1 forming a rigid support.

A hollow post 3, circular in cross section and also lying in a vertical plane, with an inside diameter slightly larger than the outside diameter of member 2, is shown with its bottom mounted in a support strata 9. This is generally concrete or earth.

Furthermore, a circular collar, 4 having approximately the same cross sectional area as that of member 3 is shown attached to member 2 by means of a setscrew. This is used to provide vertical adjustment of said concaved member 1 relative in height to the support strata 9. Said collar 4 can be provided with a means of reducing friction on its bottom face, such as ball bearings, plastic or the like to facilitate rotation about its vertical axis.

In addition to the above, apertures 6 are shown through concaved member 1 to provide passage of fluids such as water or the like.

Transport handles 7 are shown attached to the upper outer perimeter of concave member 1 providing a means of movement from storage to mounting. Refuse bags 8 are shown atop member 1 displaying the inventions main objective.

Figure 2:
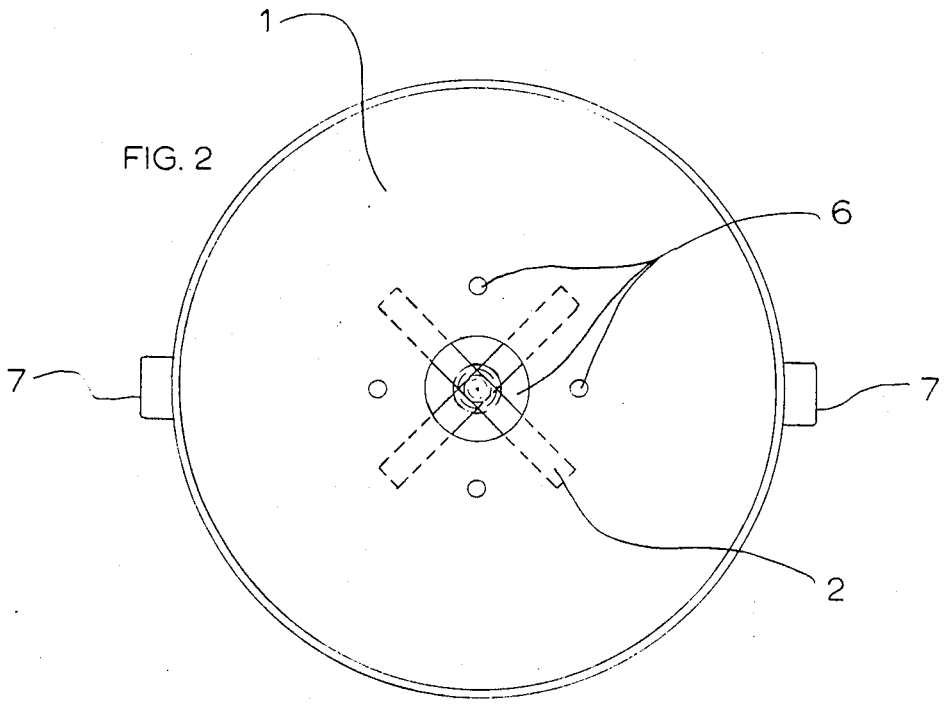
FIG. 2 is a plan view of the invention as viewed from the top.

FIG. 2 is a plan view of the invention showing the circular placement of drainage holes 6 and handles 7 in relation to the concaved support member 1. Vertical stem 2, integrally mounted to support member 1, is shown in conventional placement.

It is understood that the material forming these members may be of variable thicknesses, densities and types, some being polyethylene, fiberglass, or aluminum. It is further understood that different methods of fabrication of integral parts may be used such as welding, bolting, riveting, or the like.

It is to be appreciated that this invention can be manufactured in different sizes suiting many different container dimensions. Therefore, it is to be construed and limited only by the 2 claims which follow.

We claim:

1. A revolving refuse holder comprising the following: A circular shaped concaved rigid member lying in a horizontal plane, said concave member having aperatures, whereby providing a means for drainage of water or the like through said member, and having an integrally mounted center stem extending downward from said concave members' bottom surface, said center stem having a setscrew collar placed around the stems circumference with an inside diameter slightly larger than said center stems' outside diameter whereby providing a means of adjustment of said collar along said stem, and a circular post lying in a vertical plane having an inside diameter slightly larger than said stems' outside diameter which is hollow in nature providing a means of accepting said stem in its top, and providing a means of anchoring its bottom in a strata for support.

2. A revolving refuse holder as defined in claim 1 having handles attached to its outer perimeter whereby providing a means of transport.

* * * * *